United States Patent [19]

Caliri

[11] 4,230,025

[45] Oct. 28, 1980

[54] PNEUMATIC ACTUATOR

[75] Inventor: Charles T. Caliri, Northboro, Mass.

[73] Assignee: Jamesbury Corporation, Worcester, Mass.

[21] Appl. No.: 957,073

[22] Filed: Nov. 2, 1978

[51] Int. Cl.[3] ..... F01B 3/04

[52] U.S. Cl. ..... 92/31; 92/99

[58] Field of Search ..... 92/31, 33, 13.6, 103 F, 92/99; 251/58

[56] References Cited

U.S. PATENT DOCUMENTS

| | | | |
|---|---|---|---|
| 1,781,189 | 11/1930 | Nilson et al. | 92/31 X |
| 2,883,144 | 4/1959 | Kendig | 92/31 X |
| 2,998,805 | 9/1961 | Usab | 92/33 |
| 3,153,986 | 10/1964 | Mitchell | 92/33 |
| 3,207,468 | 9/1965 | Lauducci et al. | 92/31 X |
| 3,367,365 | 2/1968 | Stevens | 251/58 X |
| 3,625,114 | 12/1971 | Golden | 92/99 X |
| 3,872,777 | 3/1975 | Mastis | 92/103 F |
| 3,911,793 | 10/1975 | Izumi | 92/33 |
| 4,033,232 | 7/1977 | Benjamin et al. | 92/13.6 X |
| 4,086,036 | 4/1978 | Hagen et al. | 92/99 X |

FOREIGN PATENT DOCUMENTS

| | | | |
|---|---|---|---|
| 161017 | 10/1957 | Sweden | 92/31 |

*Primary Examiner*—Irwin C. Cohen

*Attorney, Agent, or Firm*—Oblon, Fisher, Spivak, McClelland & Maier

[57] ABSTRACT

A pneumatic actuator having a cap-shaped diaphragm cam rigidly attached to a resilient diaphragm retained in an actuator housing. The diaphragm cam is provided with opposed drive slots cut through the wall thereof, and with at least one correction slot cut through the wall at a bottom edge thereof. A drive pin coupled to a drive shaft is rotatably mounted with the drive slot such that a vertical movement of the diaphragm cam produces a rotational movement of the drive pin and the drive shaft. A correction cam having a shape corresponding to that of the correction slot is formed in the actuator housing beneath the correction slot and is firmly seated within the correction slot upon descent of the diaphragm cam to correct any rotational movement of the diaphragm cam.

4 Claims, 6 Drawing Figures

PNEUMATIC ACTUATOR

BACKGROUND OF THE INVENTION

1. Field of the Invention:

This invention relates to a pneumatic actuator, and more particularly to a pneumatic actuator coupled to a valve stem for producing a rotational movement of the valve stem.

2. Description of the Prior Art:

In the prior art, pneumatic actuators have been disclosed for converting the linear motion of a flexible diaphragm to a rotary movement of a valve stem. Generally, the pneumatic actuators of the prior art couple the diaphragm to the valve stem by means of a piston having one or more grooves in the periphery thereof, engaging pins fixed to the body of the piston and connected to the valve stem. Thus, according to the conventional design, a pressurization of the diaphragm produces a vertical movement thereof, which in turn produces a reciprocal movement of the piston, and thereby a rotational response in the valve stem.

However, in the operation of the conventional pneumatic actuator, considerable frictional forces are experienced during the operation of the piston assembly, which mandates a relatively high diaphragm pressurization force. Furthermore, the piston assembly itself is fairly large, and thus the conventional pneumatic actuator becomes impractical for those applications where space is at a premium. Furthermore, the pneumatic actuators of the prior art often employ additional tensioning devices for biasing the diaphragm towards one of its terminal positions. Thus, a considerable number of parts are used in the conventional pneumatic actuator assembly, and accordingly the actuator cost and reliability is proportionately adversely affected.

Examples of pneumatic actuators found in the prior art are U.S. Pat. No. 3,929,058 and U.S. Pat. No. 3,758,069.

In order to overcome the shortcomings of pneumatic actuators found in the prior art, an improved pneumatic actuator has been devised and is disclosed in copending U.S. Patent Application Ser. No. 957,072 filed Nov. 2, 1978 by Rawstron et al., incorporated by reference herewith. This improved pneumatic actuator described in more detail hereinafter, employs a hollow cap-shaped cam having opposed contoured slots. This cam is rigidly attached to a linearly propelled resilient diaphragm within the actuator. A rotatable pin in communication with the slots is coupled to a shaft penetrating the actuator housing, such that a linear motion of the cam results in a rotational force being applied by the cam slots against the rotatable pin, and therefore a corresponding rotation of the shaft.

While the fundamental concept of using the diaphragm and diaphragm cam in combination with the former preventing the latter from rotating, is acceptable where rotational stopping positions are not critical, e.g. for actuating ball valves, this concept may suffer in applications where precise angular rotation is mandatory because a degree of torsional compliance in the diaphragm is normal and may result in cam rotation.

SUMMARY OF THE INVENTION

Accordingly, one object of this invention is to provide a novel pneumatic actuator wherein the rotational movement produced by the actuator is precisely controlled.

Another object of this invention is to provide a novel pneumatic actuator wherein the torsional compliance of a resilient diaphragm is corrected.

These and other objects are achieved by providing a novel pneumatic actuator having a resilient diaphragm rigidly attached to a hollow cap-shaped diaphragm cam. The diaphragm cam is provided with cam slots which communicate with a drive pin connected to a valve stem drive shaft. The diaphragm and diaphragm cam are mounted within an actuator housing such that upon pressurization of the diaphragm and the resultant linear movement thereof, the cam surfaces of the cam slots force the drive pin to turn within the slots and correspondingly to turn a valve stem driver connected to the drive pin. A correction cam is formed in the floor of the housing to engage during descent of the diaphragm cam a correspondingly dimensioned correction slot cut into the base of the diaphragm cam, such that any rotational movement of the diaphragm cam is corrected by seating of the correction cam within the diaphragm cam correction slot.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
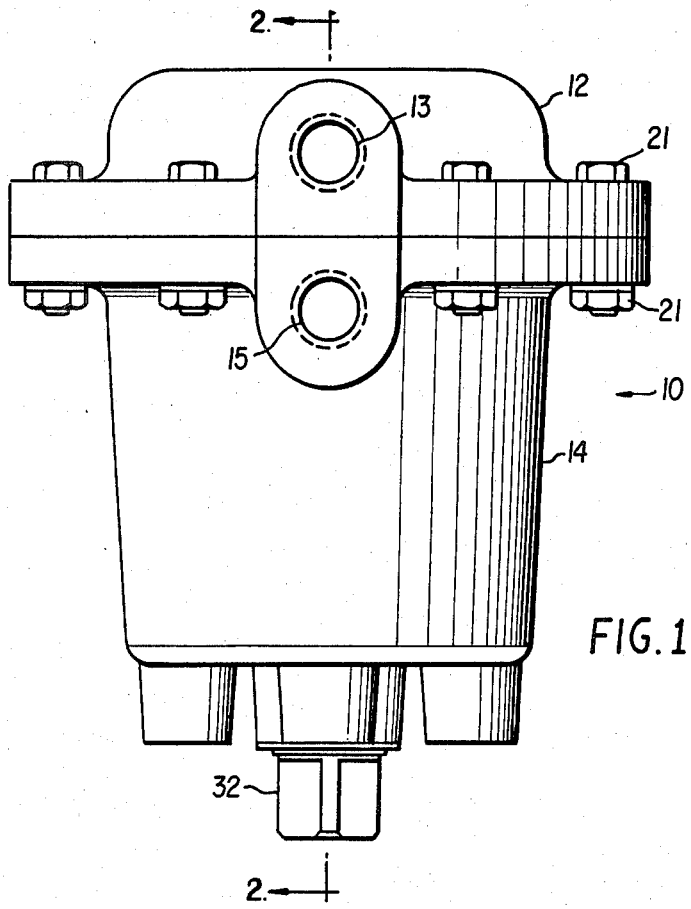
FIG. 1 is a front elevation view of the pneumatic actuator of the present invention.
Figure 2:
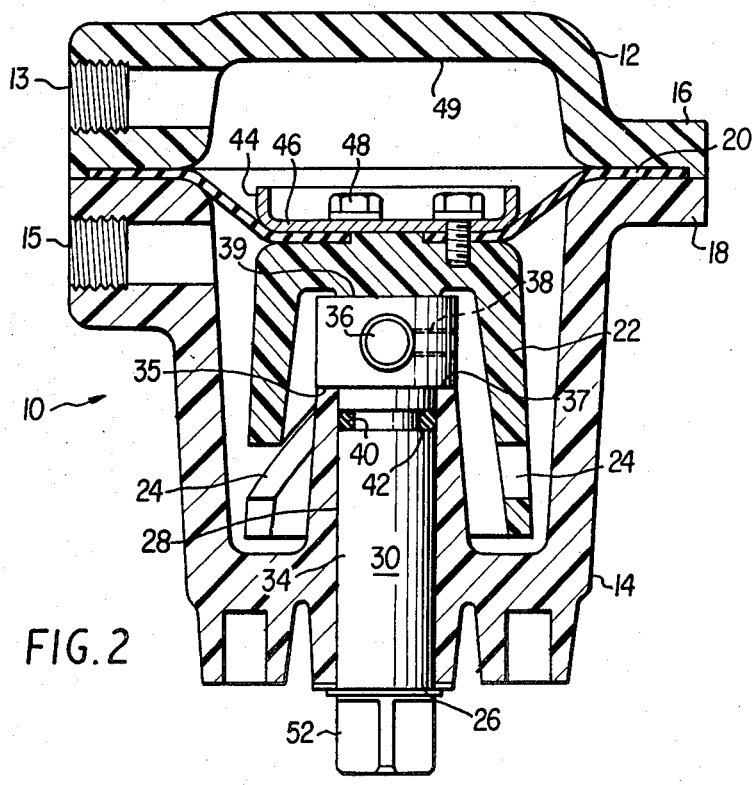
FIG. 2 is a vertical cross-sectional view taken along the lines 2—2 of the pneumatic actuator of FIG. 1 in the valve closed position.
Figure 3:
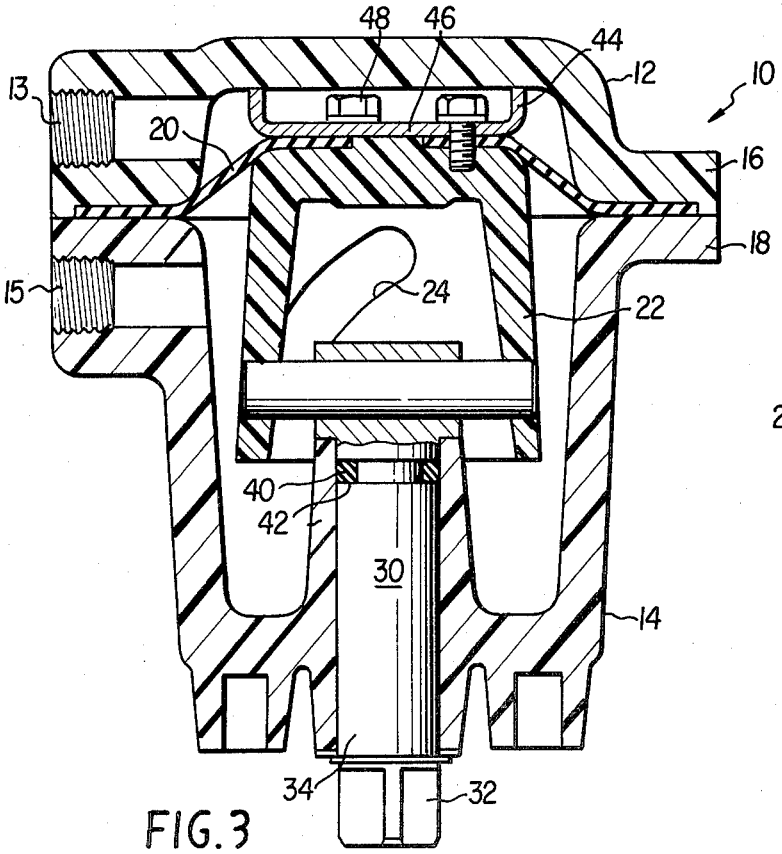
FIG. 3 is a vertical cross-sectional view taken along the lines 2–2 of the pneumatic actuator of FIG. 1 in the valve open position.
Figure 4:
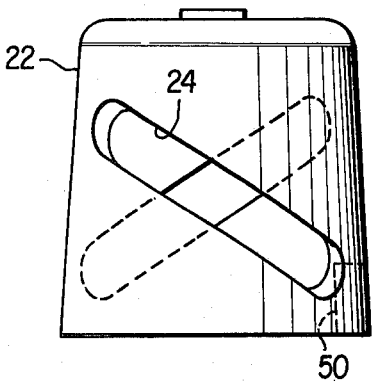
FIG. 4 is a front view of the diaphragm cam of the pneumatic actuator of the invention.

Referring now to the drawings, wherein like reference numerals designate identical or corresponding parts throughout the several views, and more particularly to FIGS. 1–3 thereof, the pneumatic actuator 10 of the invention is seen to be formed of an upper housing 12, and a lower housing 14, each having peripheral flanges 16 and 18, respectively, between which is firmly held a flexible and resilient diaphragm 20. The upper and lower housings 12 and 14 are further provided with upper and lower pressurization ports 13 and 15, respectively, for applying a pressurized fluid to a particular side of the diaphragm 20. Rigidly attached to the diaphragm 20 is a hollow generally cap-shaped diaphragm cam 22 having a pair of opposed cam drive slots 24 cut into the walls of the cam 22.

As shown in FIGS. 2 and 3, the lower housing 14 is provided with an opening 26 in the bottom thereof. A cylindrical bore 28 in communication with the opening 26 is formed within the lower housing 14. Within the bore 28 is located the shaft 34 of a valve stem driver 30, the shaft 34 having a diameter comparable to that of the bore 28. A generally rectangular stem head 32 is attached to the end of the shaft 34 exterior to the lower housing 14. At the other end of the shaft 34 interior to the actuator housing, the valve stem driver 30 is provided with a drive pin 36 mounted in a hole drilled radially through the shaft 34. A shoulder 35 is machined into the shaft 34 and provides a support by which the shaft 34 is seated on the interior annular edge 37 of the bore 28. Thus, the shaft 34 of the valve stem driver 30, while rotatably movable within the cylindrical bore 28, is nevertheless restrained in the bore 28 by the shoulder 35 and the stem head 32 and is precluded thereby from moving vertically within the bore 28.

As seen in FIG. 2, the drive pin 36 is maintained in place within the driver shaft by means of a set screw 38. Also, the opposite ends of the drive pin 36 communicate with the opposed cam drive slots 24 of the diaphragm cam 22. Thus, the drive pin 36 is rotatable within the diaphragm cam drive slots 24.

To assure adequate sealing between the shaft 34 of the stem driver 30 and the bore 28 of the lower housing 14, an O-ring is provided in a recessed ring 42 formed in a portion of the shaft 34 within the bore 28.

As seen in FIGS. 2 and 3, provided above the diaphragm in the upper housing 12 is a diaphragm plate 44 having the shape of a shallow cup or cap. The closed end 46 of the plate 44, the diaphragm 20, and the diaphragm cam 22 are rigidly connected by hex head screws 48. Thus, these elements, 20, 22, and 44 travel as one unit in accordance with the flexing of the diaphragm 20 during pressurization thereof.

Figure 5:
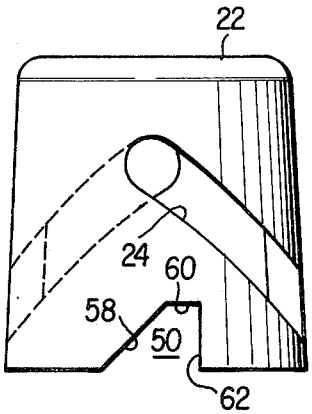
FIG. 5 is a side view of the diaphragm cam of the pneumatic actuator of the invention; and, FIG. 6 is a vertical cross-sectional view of the lower actuator housing according to the invention, showing the engagement of a correction cam and a diaphragm cam.
Figure 6:
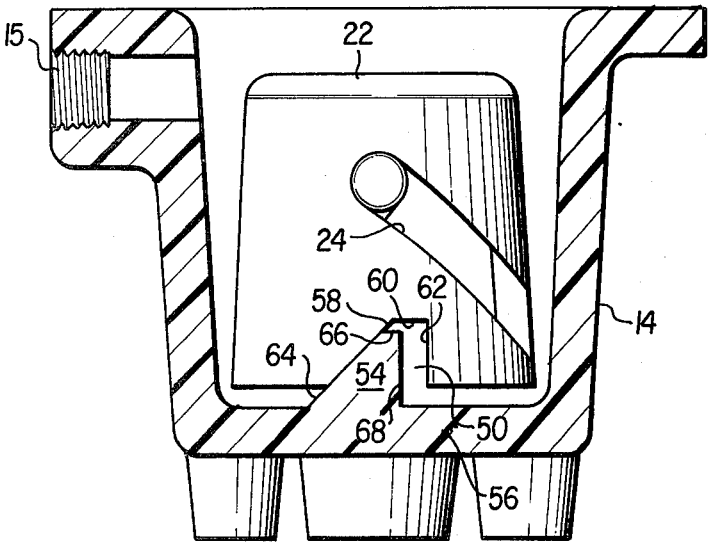

As shown in FIGS. 5 and 6, at least one correction slot is formed between the opposed drive slots 24 in the wall of the cup-shaped diaphragm cam 22 along the bottom edge 52 thereof. A correction cam 54 is formed below the correction slot 50 in the floor 56 of the lower housing, with one correction cam 54 provided for each correction slot 50. Preferably, a pair of opposed correction slots 50 are provided with corresponding correction cams 54. Each correction slot 50 is formed generally into a trapezoidal shape, with oblique, horizontal and vertical surfaces 58, 60 and 62, respectively. Likewise, the correction cam 54 is provided with correspondingly dimensioned oblique, horizontal and vertical cam surfaces 64, 66 and 68 respectively.

The pneumatic actuator of the invention is operated by applying a pressurized fluid to either the upper pressurization port 13 or the lower pressurization port 15. If the upper pressurization port 13 is pressurized, fluid pressure against the flexible and resilient diaphragm 20 flexes the diaphragm 20 vertically downwardly as shown in FIG. 2, and likewise the diaphragm cam 22, since the cam 22 and the diaphragm 20 are firmly connected. As the diaphragm cam 22 descends vertically, edge surfaces of the cam slots 24 exert a rotational force against the drive pin 36 producing a rotational movement thereof. The exact angular rotation of the drive pin 36 is ideally then determined solely by the amount of vertical travel of the diaphragm cam 22, which in turn is determined by the pressure applied to the diaphragm 20 and the characteristics of the flexible and resilient material which forms the diaphragm 20, and the arcuate path defined by the cam slots 24.

However, in reality the diaphragm 20 may exhibit some torsional compliance as a result of the counteracting rotational forces transmitted by the drive pin 36 through the diaphragm cam 22 to the diaphragm 20. Therefore, as the diaphragm cam 22 descends within the lower housing 14, the correction groove 50 of the diaphragm cam 22 may be slightly rotated with respect to the correction cam 54. In that event, the oblique surfaces 58 and 64 of the correction groove 50 and correction cam 54 slidingly engage until the correction cam 54 is firmly seated in the correction groove 50. At this point any rotational movement of the diaphragm cam 22 has been corrected, and thus the diaphragm assembly travels only linearly within the actuator housing. Therefore, the degree of rotation of the drive pin 36 is unmistakably defined by the arcuate path of the drive pin 36 and the vertical movement of the diaphragm cam, thereby assuring precise angular rotation of the valve stem driver 30.

Upon reversing the application of pressurized fluid from the upper pressurization port 13 to the lower pressurization port 15, an upward force is applied to the diaphragm 20 producing an upward movement thereof, and of the diaphragm 22 and the diaphragm plate 44, with the diaphragm plate 44 limiting this vertical movement by making contact with the top inner surface of the upper housing 12, as shown in FIG. 3. The diaphragm cam 22 likewise vertically ascends within the pneumatic actuator 10, with the correction slot 50 disengaging the correction cam 54. Then, the drive slots 24 of the diaphragm cam 22 apply a counter rotational force to the drive pin 36 and produce a counter rotation of the valve stem driver 30.

In fabricating the pneumatic actuator according to this invention, it is noted that, depending upon the intended application, the upper and lower housings12 and 14 and the diaphragm cam 22 can be fabricated from molded plastic and can therefore be economically produced to provide a low cost pneumatic actuator. Furthermore, the correction cam 54 can be integrally molded as a portion of the lower housing 14. Also, the diaphragm 20 is fabricated of virtually any flexible material having adequate strength and resiliency to withstand the particular pressurization and number of flex cycles required by a particular application. In that regard, butyl rubber diaphragms have been previously employed, but other suitable resilient materials are well known to those of ordinary skill in the art.

Obviously, numerous modifications and variations of the present invention are possible in light of the above teachings. In particular, the number and shapes of the correction cams 54 and slots 50 can be changed as desired. Also, correction slots 50 can similarly be formed in the diaphragm plate 44, while corresponding correction cams can be provided in the ceiling of the upper housing 12. It is therefore to be understood that within the scope of the appended claims, the invention may be practiced otherwise than as specifically described herein.

What is claimed as new and desired to be secured by Letters Patent of the United States is:

1. A pneumatic actuator comprising:

a drive pin coupled to a rotatable drive shaft;

a diaphragm housing formed by an upper housing and a lower housing; a resilient diaphragm;

a cap-shaped diaphragm cam rigidly attached to said resilient diaphragm, said resilient diaphragm being mounted in said housing for restraining torsional movement of said diaphragm cam wherein said diaphragm cam is provided with a pair of opposed arcuate drive slots which engage said drive pin so as to be rotatable in said drive slots such that a linear motion of said diaphragm cam produces a rotational movement of said drive pin and said drive shaft;

said diaphragm cam having at least one correction slot of a particular shape cut through the cam wall at the bottom edge thereof and said lower housing having at least one correction cam formed at the bottom wall thereof and projecting from same, and beneath said correction slot, said correction cam and said correction slot being normally disengaged from one another, said correction cam having the shape of said correction slot, said correction cam and said correction slot having respective engagable oblique surfaces, whereby said correction cam is firmly seated in said correction slot when said diaphragm cam descends within said housing; and whereby rotational movement of said diaphragm cam is corrected and precise rotation of said drive shaft is produced.

2. A pneumatic actuator according to claim 1, comprising:

a pair of opposed correction slots cut into said diaphragm cam between said drive slots; and a pair of correction cams formed in said lower housing beneath said correction slots.

3. A pneumatic actuator according to claim 1, wherein said at least one correction slot and the corresponding correction cam each have a trapezoidal shape.

4. A pneumatic actuator according to claim 1, wherein said lower housing is molded of plastic and said correction slot is integrally molded as a portion of said lower housing.

* * * * *